US006390492B1

(12) United States Patent
Bumgarner et al.

(10) Patent No.: US 6,390,492 B1
(45) Date of Patent: May 21, 2002

(54) SNOWBOARD BINDING SYSTEM WITH TOOL-LESS ADJUSTMENTS

(75) Inventors: Scott E. Bumgarner; Ryan P. Bumgarner, both of San Diego, CA (US)

(73) Assignee: Sidway Sports, LLC, Pacific Beach, CA (US)

( * ) Notice: Subject to any disclaimer, the term of this patent is extended or adjusted under 35 U.S.C. 154(b) by 0 days.

(21) Appl. No.: 09/510,043

(22) Filed: Feb. 22, 2000

(51) Int. Cl.[7] ..... A63C 5/00

(52) U.S. Cl. ..... 280/607; 280/618; 280/14.2; 280/624

(58) Field of Search ..... 280/613, 611, 280/616, 617, 618, 623, 624, 625, 626, 627, 628, 630, 631, 632, 633, 634, 14.2, 607; 24/68 SK, 70 SK

(56) References Cited

U.S. PATENT DOCUMENTS

| | | | | |
|---|---|---|---|---|
| 5,261,689 A | | 11/1993 | Carpenter et al. | |
| D346,419 S | | 4/1994 | Carpenter | |
| 5,356,170 A | | 10/1994 | Carpenter et al. | |
| 5,416,952 A | | 5/1995 | Dodge | |
| 5,660,410 A | * | 8/1997 | Alden | 280/627 |
| 5,692,765 A | | 12/1997 | Laughlin | |
| 5,727,797 A | | 3/1998 | Bowles | |
| 5,745,959 A | | 5/1998 | Dodge | |
| 5,758,895 A | | 6/1998 | Bumgarner | |
| 5,863,188 A | * | 12/1998 | Alden | 280/627 |
| 5,857,700 A | | 1/1999 | Ross | |
| 5,887,318 A | * | 3/1999 | Nicoletti | 24/71 SK |
| 5,915,718 A | | 6/1999 | Dodge | |
| 5,971,407 A | * | 10/1999 | Zemke et al. | 280/14.2 |
| 5,975,557 A | * | 11/1999 | Snoke et al. | 280/624 |
| 6,009,638 A | | 1/2000 | Maravetz et al. | |
| 6,027,136 A | | 2/2000 | Phillips | |
| 6,056,300 A | * | 5/2000 | Carpenter et al. | 280/14.2 |
| 6,065,770 A | * | 5/2000 | Hansen et al. | 280/617 |

FOREIGN PATENT DOCUMENTS

| | | |
|---|---|---|
| EP | 804950 | * 11/1997 |
| EP | 852958 | * 7/1998 |

* cited by examiner

*Primary Examiner*—Brian Johnson
*Assistant Examiner*—Bryan Fischmann
(74) *Attorney, Agent, or Firm*—Price and Gess

(57) ABSTRACT

A soft boot snowboard binding system having tool-less adjustments to permit a custom fit for maximum comfort and control. The adjustments, once made, are secure against unwanted release caused by environmental elements or hard use. A quick-release lever and buckle provide fast in and out action upon easy manual operation of the buckle, but resists all unwanted releases or jamming from snow build-up. A tool-less forward lean adjuster carries a concealed philips screwdriver bit which inserts into the adjuster plate to provide a screwdriver to tighten mounting screws or other fasteners on the snowboard binding, as needed.

30 Claims, 4 Drawing Sheets

SNOWBOARD BINDING SYSTEM WITH TOOL-LESS ADJUSTMENTS

BACKGROUND OF THE INVENTION

1. Field of the Invention

The present invention relates to the field of snowboard bindings and more particularly pertains to snowboard bindings for a generic soft boot.

2. Description of Related Art

Snowboards use bindings to attach a rider's feet to the snowboard with one binding for each foot. The bindings are generally rigidly fixed to the snowboard and provide some mechanism for securing a rider's boot to the board. Ideally, a binding should hold a rider's boot firmly but comfortably and be easy to fasten and unfasten. One of the major disadvantages of some snowboard bindings are that it takes considerable effort to strap the boot into the binding and to remove a boot from the binding which has to occur each time the snowboard rider boards a lift.

Although the desirability of a snowboard binding that has a quick step-in and release feature has been addressed in U.S. Pat. No. 5,143,396 for securing a boot to a binding, U.S. Pat. No. 5,692,275 which shows a rear entry step-in snowboard binding, and U.S. Pat. No. 5,857,700 which shows a quick release snowboard binding for a soft boot, or U.S. Pat. No. 5,758,895 which provides for a quick release binding strap and locking bar assembly for use with a variety of support baseplates, none of these prior art patents, or the prior art in general has addressed the problem of custom fitting a snowboard binding to a rider's boot, as has the present invention, along with the ability to make critical comfort adjustments without the use of tools, or the ability to fasten screws that may have come loose during hard use on the mountain with the use of a tool that is accessible and ready for use as part of the binding itself. Moreover, the prior art has tried but failed to provide a quick-release buckle that cannot be accidentally opened by environmental conditions and does not become jammed by snow.

SUMMARY OF THE INVENTION

The snowboard binding system of the present invention provides tool-less adjustments to the binding for a custom fit providing maximum comfort and control. The adjustments are made by a cammed lever that provides screw attachment and locking resistance that prevents release by other than manual means. A tool-less back plate lean adjustment block for controlling lean of the back plate carries a screwdriver bit which can be used in conjunction with the lean adjustment block to tighten any baseplate mounting screws that may have loosened as the result of hard use. A quick release lever and buckle provides fast in and out action upon easy manual operation of the buckle which resists all unwanted releases and jamming from snow build-up by use of an interlocked latching member and disengaging lever.

BRIEF DESCRIPTION OF THE DRAWINGS

The exact nature of this invention as well as its objects and many of its advantages will be readily appreciated as it becomes better understood by reference to the following detailed description when considered in conjunction with the accompanying drawings and in which like reference numerals designate like parts throughout the figures thereof and.

DETAILED DESCRIPTION OF THE PREFERRED EMBODIMENTS

Figure 1:
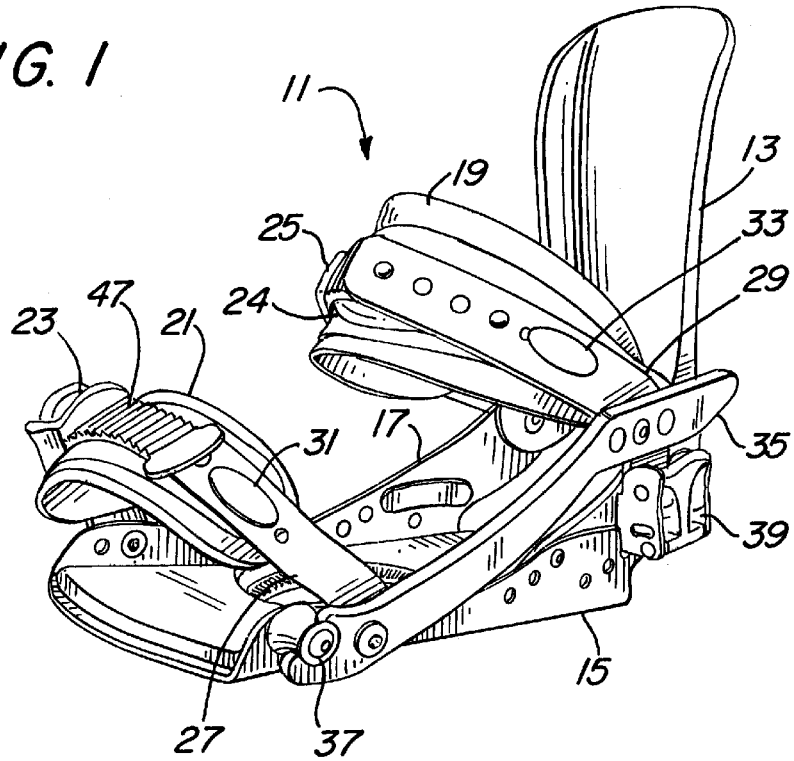
FIG. 1 is a side perspective view of the snowboard binding according to the present invention.

FIG. 1 shows the snowboard binding 11 of the present invention incorporating the features of the present invention. Snowboard binding 11 has three major structural parts that are connected together. The baseplate 15 is attached to the snowboard in a manner that is well known in the art and will not be described herein. A heel cup 17 is attached to the baseplate 15. A highback or back plate 13 is in turn attached to the heel cup 17.

An ankle strap 19 is attached by its one end to the heel cup 17 and by its other end to a quick release lever 35 which is in turn, attached to a buckle 39, mounted on the other side of the heel cup 17. A ratchet adjustment mechanism 25 riding on the ridged side 24 of the ankle strap 19 allows for tightening and loosening of the strap.

A toe strap 21 is attached by its one end to the front of the baseplate 15 and at its other end to the front of the quick release lever 35. A ratchet mechanism 23 riding on the ridged side 47 of the toe strap provides for tightening and loosening of the toe strap 21.

To provide for custom placement of the pad on ankle strap 19 to eliminate pressure points on the foot, tool-less adjustment mechanism 33 may be utilized to center the pad correctly. Likewise, for the toe strap 21, tool-less adjustment mechanism 31 permits for centering of the pad to eliminate pressure on the toe joints.

After all adjustments are made and a boot inserted into the binding, the binding is fastened by the quick release lever 35 engaging a catch 37 at its front end and slipping into the locking buckle 39 at the other end.

Figure 2:
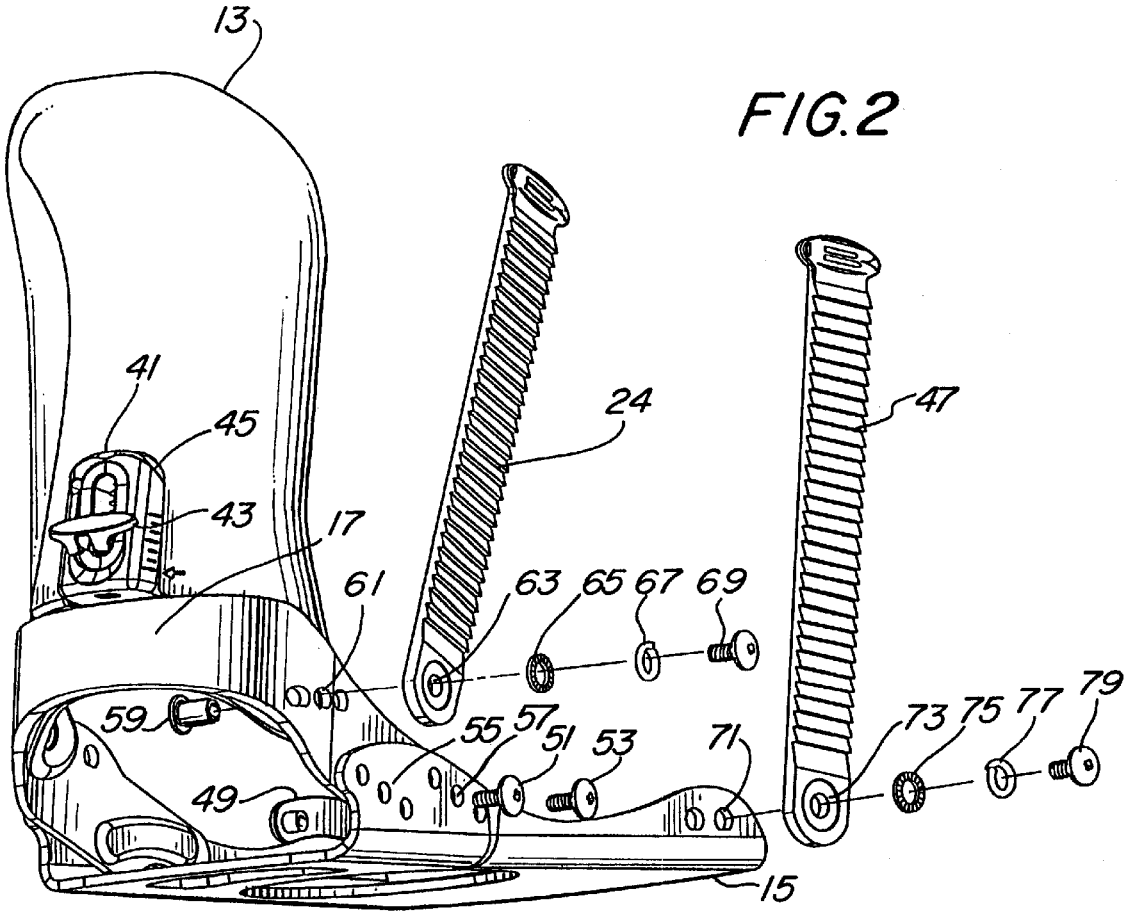
FIG. 2 is an exploded view of a portion of the snowboard binding of FIG. 1.

Referring now to FIG. 2, we see an exploded view of how the toe strap 21 and ankle strap 19 are fastened to the binding, and the location and function of a back plate lean adjustment. The baseplate 15 has located at its front section, along both sides a plurality of apertures 71 for fastening the toe strap 47 to one side of the front of the baseplate. The fastening mechanism utilized to fasten the strap 47 to the baseplate permits pivotal motion of the strap 47 without permitting disengagement. The fastening mechanism consists of a bolt 79 with a threaded shaft which fits through aperture 73 at one end of the strap 47 and through one of the plurality of apertures 71 on the baseplate 15. Located between the head of the bolt 79 and the surface of the strap, around aperture 73, is a ratchet washer bolt 75 and a split washer 77 riding on the ratchet washer. The threaded portion of the bolt 79 engages a nut (not shown). The ratchet washer 75 and the split washer 77 allow the shaft of bolt 79 to rotate without loosening it from the nut.

The ankle strap 19, which is similar in construction to the toe strap 21, has an aperture 63 at one end by which it is fastened to the heel cup 17 through one of the multiple apertures 61 in heel cup 17. A bolt 69 with a threaded shaft passes through the aperture 63 in strap 24 and one of the multiple apertures 61 in the heel cup. A ratchet washer 65 and a split washer 67 is located between the head and the surface of the strap around aperture 63. A portion of bolt 69 threads into a cylinder-type nut 59 which receives the threaded shaft of bolt 69 without jutting into the interior of the heel cup. This arrangement allows the bolt-nut pair to rotate without loosening.

Base plate 15 has a first angled row of apertures 55 and a second angled row of apertures 57 running parallel thereto on both sides of the baseplate 15. A pair of bolts 51 and 53 fit into complementing apertures on the first row 55 and the second row 57 and through a single pair of apertures on the heel cup 17 (not shown) to thread into a nut plate 49 on the inside of the heel cup. The plurality of parallel apertures 55 and 57 allow the user to custom locate the heel cup with respect to the baseplate by permitting both a forward-backward and up-down relationship movement.

A lean adjustment block 45 fits into a recess 41 in the back plate 13. The lean adjustment block 45 causes back plate 13 to lean forward towards the toe, or back towards the heel of baseplate 15, as the back plate pivots on the nut and bolt arrangement that fastens it to the heel cup. The lean adjustment block 45 moves downward in recess 41 of back plate 13 whenever the back plate pivots forward and moves upward in recess 41 when the back plate 13 is upright or is pivoting backwards. A hand tightening and releasing lever 43 permits manual tightening and releasing of the lean adjustment block 45 against the back plate 13 while providing a secure locked position.

Figure 3:
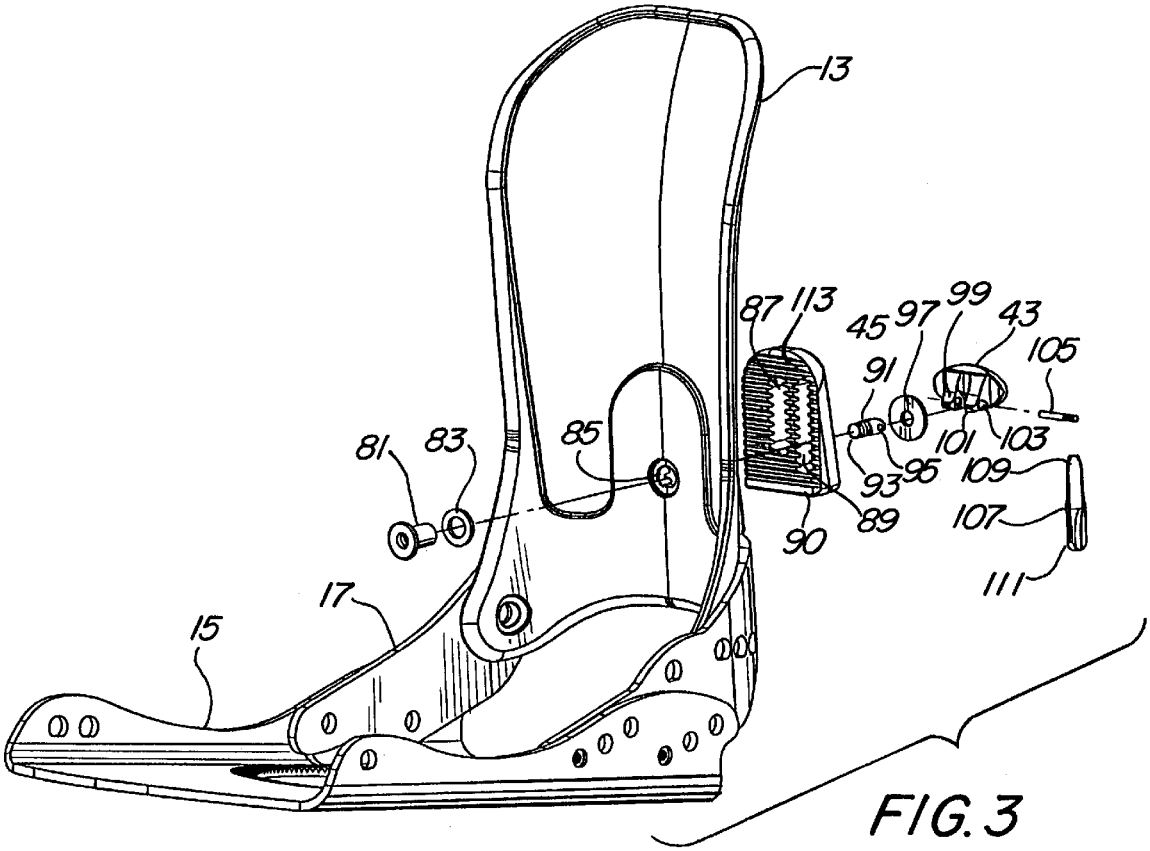
FIG. 3 is an exploded view of a portion of the snowboard binding of FIG. 1, showing the lean block of the invention.

Referring now to FIG. 3, we see an exploded view of the lean adjustment block 45 and the manually manipulatable fastening lever 43. The lean adjustment block 45 has a slotted aperture 87 therethrough which overlaps an aperture 85 in the back plate 13. A cylindrical nut 81 and the flat washer 83 are located on the inside of the back plate 13 for receiving a threaded portion 93 on a shaft 91. Shaft 91 has an aperture 95 through the end opposite its threaded portion. A washer 97 fits over the apertured end of shaft 91. The apertured end of shaft 91 enters into a recess between two cam surfaces 99 and 101 on lever 43. A pin 105 passing through apertures 103 in the cam surfaces 99 and 101 also passes through the aperture 95 in shaft 91, thereby holding it to lever 43, but permitting lever 43 to rotate on its cam surfaces against washer 97. Rotation of lever 43 around its axis will cause the threaded portion 93 of shaft 91 to thread into cylindrical nut 81 on the other side of the back plate 13, thereby tightening or loosening the lean adjustment block 45 with respect to the back plate 13. After hand tightening, locking the lean adjustment block into place is accomplished as follows. Because cams 99 and 101 have a high and a low surface, rotating lever 43 about the axis of pin 105 to a position wherein the high surfaces of cams 99 and 101 engage washer 97, causes the lean adjustment block 45 to be locked to the back plate 13.

This structure of fastening lever 43 is utilized for the manual adjustment mechanism 33 on the ankle strap 19 and the manual adjustment mechanism 31 on the toe strap 21 shown in FIG. 1.

Lean adjustment block 45 has an additional aperture 89 cut into its front side 113 for receiving a screwdriver bit 107. Screwdriver bit 107 has a tip 109 and a sloped opposite end 111 having a shape which mates with an aperture in the base 90 of lean adjustment block 45.

Figure 4:
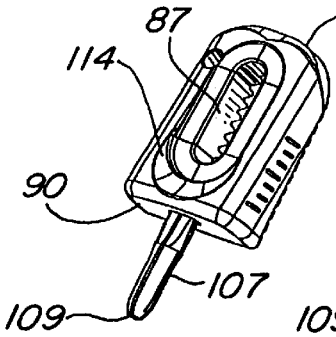
FIG. 4 is a back perspective view of a lean block according to the present invention.
Figure 5:
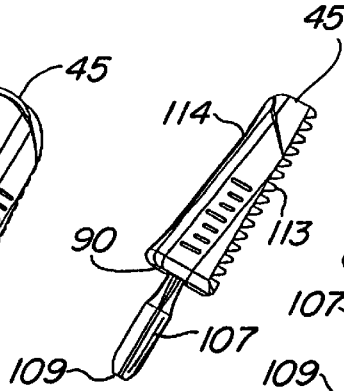
FIG. 5 is a side view of FIG. 4.
Figure 6:
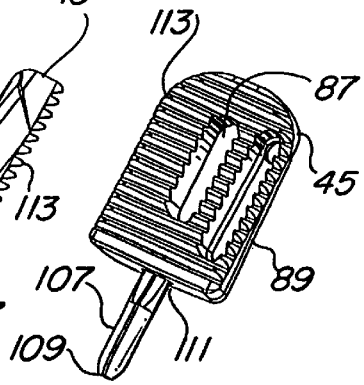
FIG. 6 is a front perspective view of the lean block of FIG. 4.

Referring now to FIGS. 4, 5, and 6, we see a more detailed view of the lean adjustment block 45. The lean adjustment block 45 has a back 114, a front 113, and a base 90. The screwdriver bit 107 fits into an aperture in the base 90 of block 45, allowing the lean adjustment block 45 to be used as a handle for the screwdriver bit 107 to tighten any loose bolts on the mounting plate of the snowboard binding, as required. The front 113 of the lean adjustment block 45 has a plurality of ridges which mate with like ridges on the back plate 13 (not shown) in recess 41. These mating ridges allow the lean adjustment block 45 to move in step increments against the back plate 13 without slipping.

Figure 7:
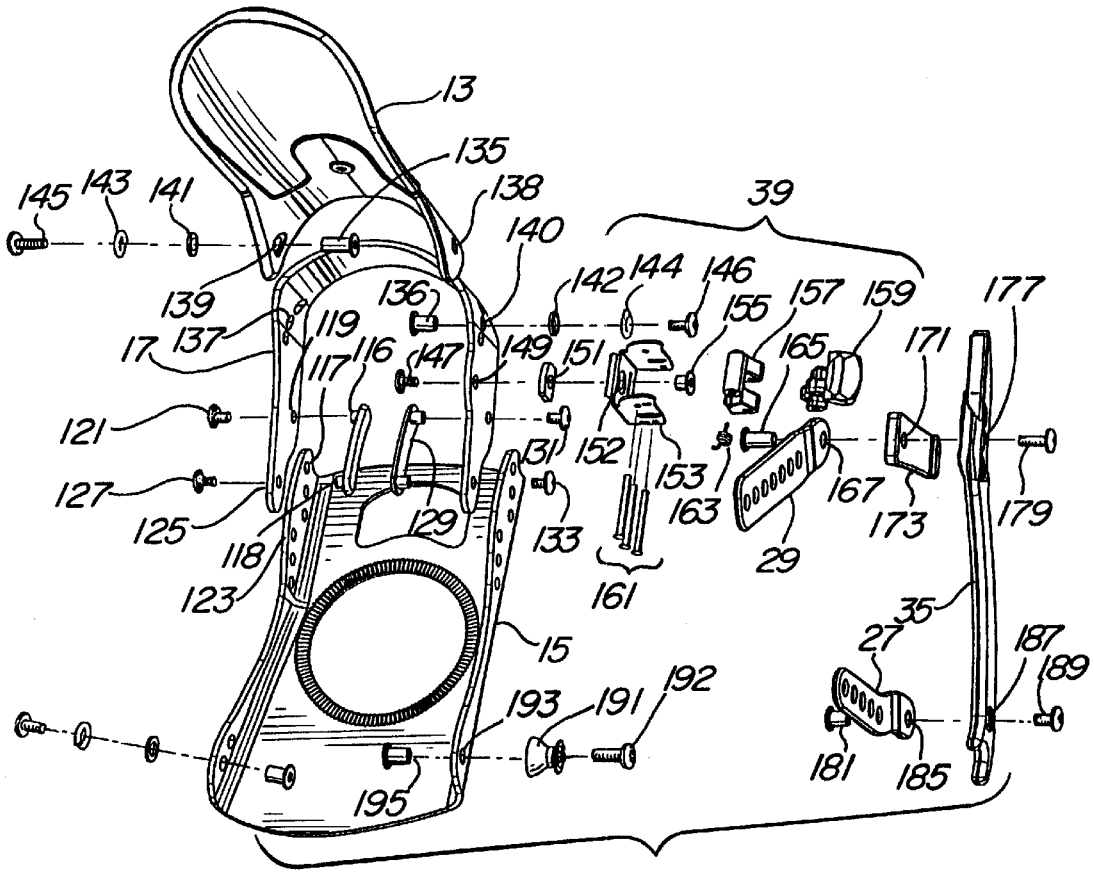
FIG. 7 is an exploded view of certain parts of the snowboard binding of FIG. 1.

Reference is now made to FIG. 7 for a more detailed view of the interconnection and interaction of the three structural parts of the binding, the back plate 13, the heel cup 17 and the baseplate 15, with the quick release lever 35 and the buckle 39.

The back plate 13 has a plurality of apertures 139, 138 on opposite sides which mate with one of a plurality of apertures 137, 140 on heel cup 17. Back plate 13 slips into the inside of heel cup 17, allowing the back plate to be moved forward or backward as it mates with the different set of apertures 137, 140 on heel cup 17. The back plate 13 is pivotally attached to heel cup 17 through selected apertures. A cylindrical nut 135 passes through aperture 139 of back plate 13 and the selected one of apertures 137 on the heel cup, to engage a threaded portion of bolt 145, which passes through a split washer 143 and ratchet washer 141. On the other side of the heel cup 17, a cylindrical nut 136 passes through aperture 138 on the back plate 13 and a respective one of apertures 140 on heel cup 17 to engage the threaded portion of a nut 146 which passes through a split washer 144 and ratchet washer 142. This fastening mechanism of cylindrical nut, split washer, ratchet washer and threaded bolt, allows for rotatably holding of the back plate 13 to the heel cup 17 without loosening.

The heel cup 17 is fastened to the baseplate 15 by a pair of bolts that thread into a nut plate on each side of the heel cup 17. On one side of heel cup 17, bolts 121 and 127 pass through one of the apertures in the aperture rows 123, 117, respectively, in the base plate and through apertures 119, 125 in the heel cup 17 to thread into cylinder nut plate 115 which has a pair of internally threaded cylinder nuts, 116 and 118, that mate with the threads of bolts 121, 127, respectively. The spacing of cylinders 116 and 118 on nut plate 115 corresponds with the spacing between the parallel rows of apertures 117 and 123. These parallel rows of apertures 117 and 123 allow the user to adjust the heel cup both in a forward-rearward direction and an upward-downward direction. On the other side of the heel cup 17, another pair of bolts 131, 133 pass through apertures on that side of the heel cup and baseplate to another bolt plate 129. Heel cup 17 is preferably located within the upward extensions of the baseplate 15 but could be located on the outside, if so desired.

A catch 191 for the quick release lever 35 is located at the toe section of baseplate 15. Catch 191 is fastened to the baseplate 15 by a cylindrical nut 195 and a bolt 192 passing through the catch and aperture 193 in baseplate 15.

The quick release lever 35 has a tongue portion 173 connected to the handle end 177 of the lever 35 by a nut 179 passing through apertures at the handle portion 177, the aperture 171 in the tongue 173, and an aperture 167 in ankle strap 29, to cylindrical nut 165. Toe strap 27 is attached to the front end of quick release lever 35 by a nut 189 passing through an aperture 187 in the front portion of quick release lever 35, through an aperture 185 in toe strap 27 to cylindrical nut 181.

A buckle shown in an exploded view has a frame 153 which is fastened to the heel cup 17 by a nut 147 passing through an aperture 149 in heel cup 17 through an aperture in spacer 151 and an aperture 152 in frame 153 to cylindrical nut 155. The frame 153 has a plurality of holes through its sides through which three shafts 161 pass, respectively. A latching member 157 engages a pair of these shafts. A disengaging lever 159 engages a different pair of these shafts. A spring 163 forces the latching member to a closed position.

Figure 8:
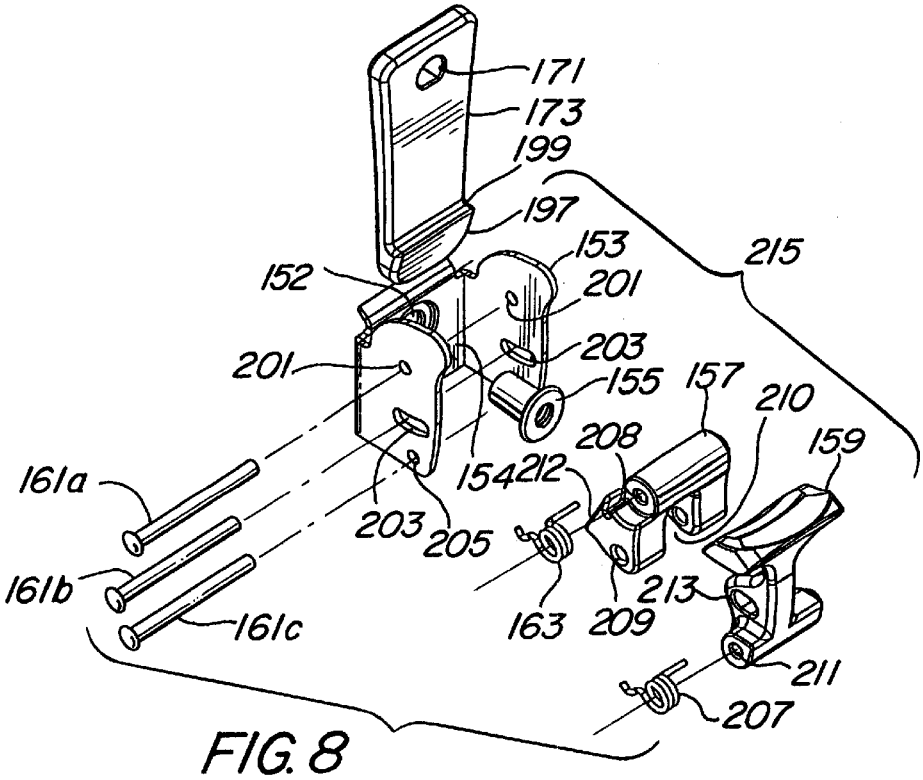
FIG. 8 is an exploded view of the buckle according to the present invention.
Figure 13:
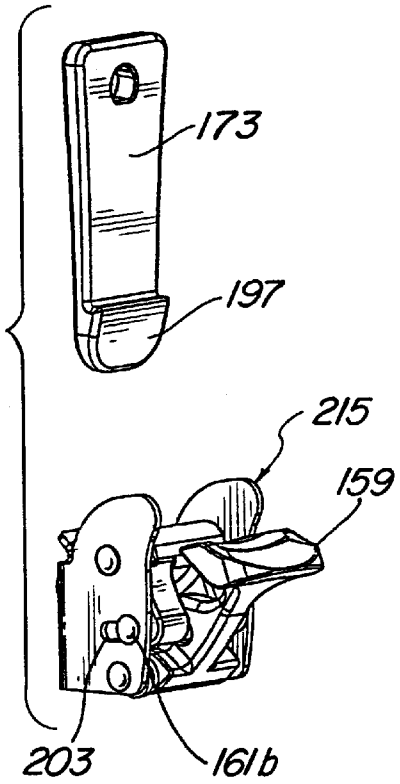
FIG. 13 is a perspective view of the buckle with disengaging lever moved to a position to allow disengagement of the strap from the buckle.

The details of the buckle 215 are more specifically illustrated in FIG. 8. A tongue 173 of the ankle strap is shown in a position to be inserted into the frame 153 of the buckle. The frame 153 contains a pair of rounded apertures 201 on the top, a pair of slotted apertures 203 in the middle, and another pair of rounded apertures 205 on the bottom. Shaft 161 a passes through apertures 201, shaft 161*b* passes through the slotted apertures 203, and shaft 161c passes through the apertures 205. Latching member 157 has a lengthwise aperture 208 through its top portion which is adapted to fit within the width of the frame 153. Shaft 161*a* passes through apertures 201 in the frame 153, through spring 163 and through aperture 208 on the latching member 157. The spring 163 biases latching member 157 to a closed position, against the back 154 of frame 153. The edge 212 of latching member 157 engages the ridge 199 of the tongue 173, thereby holding it firmly against the back 154 of frame 153 when the tongue 173 has been fully inserted into the frame 153 of the buckle.

Shaft 161*b* passes through the slotted apertures 203 in the frame 153 and through apertures 209 in the bottom half of latching member 157 which is a pair of legs having a recess 210 therebetween. A disengaging lever 159 has an extended body with a slotted aperture 213 at its mid section which fits into the recess 210 of latching member 157. When assembled, the shaft 161*b* passes through slots 203 of the frame 153, circular apertures 209, in latching member 157, and slots 213 in the mid section of disengaging lever 159. Shaft 161c passes through apertures 205 in the frame 153 as well as through spring 207 and apertures 211 in the bottom portion of disengaging lever 159. Spring 207 biases disengaging lever 159 to a closed position, towards the back 154 of frame 153.

Figure 12:
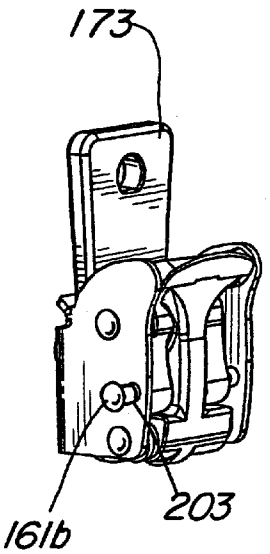
FIG. 12 is a perspective view of the buckle in a locked position holding the tongue portion of the strap.
Figure 11:
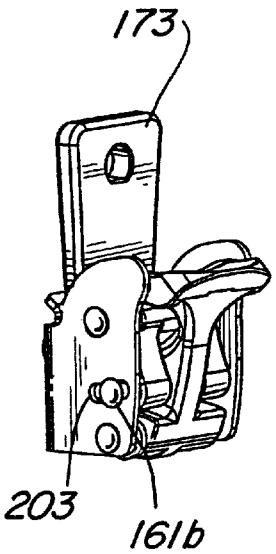
FIG. 11 is a perspective view of the buckle receiving the tongue portion of the strap into a locked position.
Figure 10:
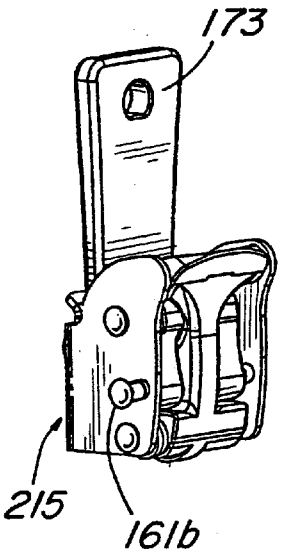
FIG. 10 is a perspective view of the buckle receiving the tongue portion of a strap.
Figure 9:
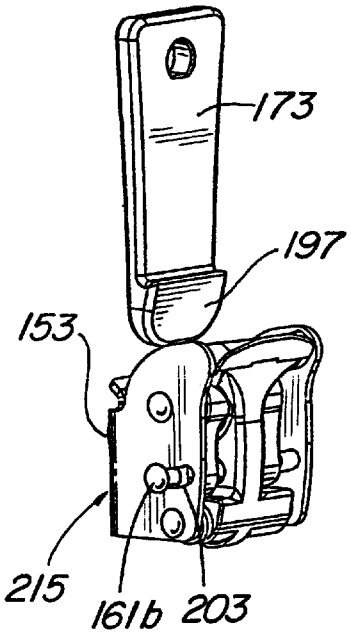
FIG. 9 is a perspective view of the buckle in a closed position.

FIGS. 9, 10, 11, 12, and 13 illustrate the operation of the latching buckle 215 during the various stages of insertion and release of the tongue 173. As shown in FIG. 9, prior to insertion of tongue 173, specifically the tip portion 197 of tongue 173, into the buckle 215, the latching member and disengaging lever are biased by the springs to tightly engage the back wall of frame 153. The middle shaft 161b is at one extreme of slots 203 in the frame, as shown. During insertion of tongue 173 into the frame, middle shaft 161b starts to move towards the other extreme in slots 203 as shown in FIGS. 10 and 11, until the ridge or tip 197 of a tongue 173 is caught by edge 212 (FIG. 8) of the latching member allowing shaft 161*b* to once again revert to its extreme closed position in slot 203 as shown in FIG. 12. To extract the tongue 173 and specifically tip 197 of tongue 173 from the latched buckle 215, disengaging lever 159 must be manually pulled down from the top, causing the bottom part of disengaging lever to rotate about shaft 161*c* as shaft 161*b* is moved to the other extreme in slot 203. As a result of this movement of shaft 161*b* to the other extreme of slot 203, the edge 212 of latching member 157 is moved away from the back of the frame allowing the tongue 197 to be removed from the latching buckle 215.

What is claimed is:

1. A snowboard binding having a baseplate for attachment to a snowboard, a heel cup attached to the baseplate, and a back plate pivotally attached to the heel cup, the improvement in the snowboard binding comprising:

a lean adjuster having a front surface in contact with the back plate and a back surface, the lean adjuster being releasably fastened to the back plate for movement toward and away from the heel cup to permit the back plate to pivot forward to the toe and backward, away from the toe, the lean adjuster having a first recess in the front surface sized to store and hold a screwdriver bit and a second recess to hold the screwdriver bit; and a fastener adapted for tool-less tightening and release of the lean adjuster to the back plate.

2. The lean adjuster of claim 1 wherein the fastener comprises:

a shaft having a first and second end with threads at the first end, said shaft passing through an aperture in the lean adjuster and an aperture in the back plate;

a nut on the inside of the back plate threaded to the first end of the shaft; and a lever pivotally attached to the second end of the shaft for rotating the shaft within the nut, said lever having a cam surface bearing against the back surface of the lean adjuster with the high side, when the lever is pivoted in one direction, and the low side, when the lever is pivoted in another direction.

3. The lean adjuster of claim 2 wherein the nut for the fastener is an internally threaded cylinder receiving the first end.

4. The lean adjuster of claim 1 further comprising a plurality of ridges on the front surface for engaging complementing ridges on the back plate.

5. The lean adjuster of claim 2 wherein the aperture therein is an elongated slot.

6. The snowboard binding of claim 1 wherein said lean adjuster further comprises a recess in a side sized to receive and hold one end of the screwdriver bit.

7. A snowboard binding have a baseplate for attachment to a snowboard, a heel cup attached to the baseplate, and a back plate attached to the heel cup, the improvement in the snowboard binding comprising:

a latching buckle having a frame with sides, a back, top and bottom, the frame holding a first, second and third shaft between its sides from top to bottom, a latching member pivotally mounted at its one end on the first shaft, a disengaging lever pivotally mounted at its one end on the third shaft, both the latching member and disengaging lever mounted on the second shaft at their respective other ends, the latching member adapted to receive a tongue portion of a strap inserted into the top of the frame;

a lean adjuster having a front surface in contact with the back plate and a back surface, the lean adjuster being releasably fastened to the back plate for movement toward and away from the heel cup to permit the back plate to pivot forward to the toe and backward, away from the toe, the lean adjuster having a first recess in the front surface sized to store and hold a screwdriver bit and a second recess to hold the screwdriver bit; and a fastener adapted for tool-less tightening and release of the lean adjuster to the back plate.

8. The snowboard binding of claim 7 wherein said latching buckle further comprises a first spring mounted on the first shaft and to the latching member to urge the latching member towards the back of the frame, and a second spring mounted on the third shaft and to the disengaging lever for urging the disengaging lever towards the back of the frame.

9. The snowboard binding of claim 8 wherein the second shaft of the latching buckle is mounted for pivotal and sliding motion in the sides of the frame, whereby pivotal movement of the disengaging lever about the third shaft away from the back of the frame will cause the second shaft to slide in the sides of the frame causing the latching member to pivot on the first shaft in a direction away from the back of the frame disengaging the tongue inserted into the frame and being held between the back of the frame and the latching member.

10. The snowboard binding of claim 9 wherein the latching member is pivotally mounted on the second shaft.

11. The snowboard binding of claim 10 wherein the disengaging lever is mounted for pivotal and sliding motion with respect to the second shaft.

12. The snowboard binding of claim 7 wherein the latching buckle is fastened to the heel cup.

13. The snowboard binding of claim 12 wherein the back plate is pivotally mounted to the heel cup.

14. The snowboard binding of claim 7 wherein the fastener comprises:

a shaft having a first and second end with threads at the first end, said shaft passing through an aperture in the lean adjuster and an aperture in the back plate;

a nut on the inside of the back plate threaded on to the first end of the shaft; and a lever pivotally attached to the second end of the shaft for rotating the shaft within the nut, said lever having a cam surface bearing against the back surface of the lean adjuster with the high side when the lever is pivoted in one direction and the low side when the lever is pivoted in another direction.

15. The snowboard binding of claim 14 wherein the nut for the fastener is an internally threaded cylinder.

16. The snowboard binding of claim 15 wherein the lean adjuster further comprises a plurality of ridges on the front surface for engaging complementing ridges on the back plate.

17. The snowboard binding of claim 16 wherein the lean adjuster aperture is an elongated slot.

18. The snowboard binding of claim 7 wherein the lean adjuster further comprises a recess in a side sized to receive and hold one end of the screwdriver bit.

19. A snowboard binding having a baseplate with first and second ends for attachment to a snowboard, a catch mounted on the baseplate at its first end, a heel cup attached to the baseplate at the second end, a back plate pivotally attached to the heel cup, and a quick release lever having a first and second end, said lever disposed along one side of the baseplate having one end of a toe strap attached to the first end and one end of an ankle strap, including a tongue portion attached to the second end, the first end of the lever engaging the catch mounted on the baseplate, the improvement in the snowboard binding comprising:

a latching buckle having a frame with sides, a back, top and bottom, the frame holding a first, second and third shaft between its sides from top to bottom, a latching member pivotally mounted at its one end on the first shaft, a disengaging lever pivotally mounted at its one end on the third shaft, both the latching member and disengaging lever mounted on the second shaft at their respective other ends, the latching member adapted to receive the tongue portion of the strap inserted into the top of the frame;

a lean adjuster having a front surface in contact with the back plate and a back surface, the lean adjuster being releasably fastened to the back plate for movement toward and away from the heel cup to permit the back plate to pivot forward to the toe and backward, away from the toe, the lean adjuster having a first recess in the front surface sized to store and hold a screwdriver bit and a second recess to hold the screwdriver bit; and a fastener adapted for tool-less tightening and release of the lean adjuster to the back plate.

20. The snowboard binding of claim 19 wherein said latching buckle further comprises a first spring mounted on the first shaft and to the latching member to urge the latching member towards the back of the frame, and a second spring mounted on the third shaft and to the disengaging lever for urging the disengaging lever towards the back of the frame.

21. The snowboard binding of claim 20 wherein the second shaft of the latching buckle is mounted for pivotal and sliding motion in the sides of the frame, whereby pivotal movement of the disengaging lever about the third shaft away from the back of the frame will cause the second shaft to slide in the sides of the frame causing the latching member to pivot on the first shaft in a direction away from the back of the frame disengaging the tongue inserted into the frame and being held between the back of the frame and the latching member.

22. The snowboard binding of claim 21 wherein the latching member is pivotally mounted on the second shaft.

23. The snowboard binding of claim 22 wherein the disengaging lever is mounted for pivotal and sliding motion with respect to the second shaft.

24. The snowboard binding of claim 23 wherein the latching buckle is fastened to the heel cup.

25. The snowboard binding of claim 24 wherein the back plate is pivotally mounted to the heel cup.

26. The snowboard binding of claim 19 wherein the fastener comprises:

a shaft having a first and second end with threads at the first end, said shaft passing through an aperture in the lean adjuster and an aperture in the back plate;

a nut on the inside of the back plate threaded onto the first end of the shaft; and a lever pivotally attached to the second end of the shaft for rotating the shaft within the nut, said lever having a cam surface bearing against the back surface of the lean adjuster with the high side when the lever is pivoted in one direction and the low side when the lever is pivoted in another direction.

27. The snowboard binding of claim 26 wherein the nut for the fastener is an internally threaded cylinder.

28. The snowboard binding of claim 27 wherein the lean adjuster further comprises a plurality of ridges on the front surface for engaging complementing ridges on the back plate.

29. The snowboard binding of claim 28 wherein the lean adjuster aperture is an elongated slot.

30. The snowboard binding of claim 19 wherein the lean adjuster further comprises a recess in a side sized to receive and hold one end of the screwdriver bit.

* * * * *